US012780382B2

(12) United States Patent
McDole

(10) Patent No.: US 12,780,382 B2
(45) Date of Patent: Nov. 3, 2026

(54) APPARATUS FOR MOUNTING AN OUTBOARD MOTOR TO A TRANSOM OF A BOAT

(71) Applicant: David McDole, Mountainhome, AR (US)

(72) Inventor: David McDole, Mountainhome, AR (US)

( * ) Notice: Subject to any disclaimer, the term of this patent is extended or adjusted under 35 U.S.C. 154(b) by 129 days.

(21) Appl. No.: 18/886,918

(22) Filed: Sep. 16, 2024

(65) Prior Publication Data

US 2025/0091703 A1 Mar. 20, 2025

Related U.S. Application Data

(60) Provisional application No. 63/538,774, filed on Sep. 15, 2023.

(51) Int. Cl.
*B63H 20/10* (2006.01)

(52) U.S. Cl.
CPC ..... *B63H 20/10* (2013.01)

(58) Field of Classification Search
CPC ..... B63H 20/10
USPC ..... 248/640
See application file for complete search history.

(56) References Cited

U.S. PATENT DOCUMENTS 4,013,249 A * 3/1977 Meyer ..... B63H 20/10 248/642
4,757,971 A * 7/1988 Mapes ..... B63H 20/08 248/642
4,872,859 A 10/1989 Griffiths et al.
4,890,811 A * 1/1990 Ehni ..... B63H 20/06 248/641
5,052,321 A 10/1991 Toniatti
7,878,872 B2 * 2/2011 Strobel ..... B63H 20/12 440/63
8,454,400 B1 * 6/2013 Downs, Jr. ..... B63H 20/02 440/49
8,597,066 B2 12/2013 Grez
(Continued)

OTHER PUBLICATIONS

Amazon; Dotline Adjustable Outboard Motor Tilter; https://www.amazon.com/DotLine-Dotline-Adj-Motor-Tilter/ dp/B0000AZ878.
(Continued)

*Primary Examiner* — Todd M Epps
(74) *Attorney, Agent, or Firm* — HULSEY P.C.

(57) ABSTRACT

An apparatus for mounting an outboard motor to a transom of a boat is disclosed. The apparatus includes first mounting plates and second mounting plates positioned opposite to each other. The first mounting plates and the second mounting plates connect via connecting plates. The first mounting plates connect to the transom and the second mounting plates connect to the outboard motor. The apparatus includes a first support plate connected to the transom. The first mounting plates include holes at the bottom. The holes receive a first rod that defines the bottom vertical position of the outboard motor in relation to the transom. The first support plate includes a spring member connected to a second rod at the second mounting plates. The apparatus includes an actuator drawn through the first mounting plates and the first support plate. The actuator engages the spring member to move the outboard motor vertically.

18 Claims, 8 Drawing Sheets

(56) References Cited

U.S. PATENT DOCUMENTS

| | | | | |
|---|---|---|---|---|
| 9,022,342 | B2 * | 5/2015 | Witte | B63H 20/06 248/641 |
| 9,285,072 | B1 * | 3/2016 | Banty | B62M 9/00 |
| 9,598,159 | B2 | 3/2017 | Nyren | |
| 10,220,926 | B1 * | 3/2019 | Pelini | B63H 5/125 |
| 10,293,905 | B1 * | 5/2019 | Pelini | B63H 20/10 |
| 10,370,075 | B2 * | 8/2019 | Nyren | B63H 20/06 |
| 10,583,906 | B2 | 3/2020 | Grez | |
| 10,745,095 | B2 | 8/2020 | He et al. | |
| 11,987,334 | B2 * | 5/2024 | Aichele, Jr. | B60P 3/1066 |
| 12,071,211 | B2 * | 8/2024 | Hagi | B63H 20/06 |
| 12,071,212 | B2 * | 8/2024 | Hagi | B63H 20/10 |
| 2003/0228810 | A1 | 12/2003 | Brown et al. | |
| 2004/0262488 | A1 | 12/2004 | Kozubski | |
| 2005/0279912 | A1 | 12/2005 | Kozubski | |

OTHER PUBLICATIONS

Walmart; Adjustable Outboard Motor Tilter; https://www.walmart.ca/en/ip/Garelick-Manufacturing-3003-1240-Adjustable-Outboard-Motor-Tilter/PRD476LD8BI16B8.

Aquamasters; Adjustable Outboard Motor Leverage Tilting Bar; http://www.aquamasters.com/leverbar.htm.

Stryker Boats; Prop Saver in Action; https://www.youtube.com/watch?v=VxRD8idyat4.

Nucanoe; U-Joint Tiller Extension; https://www.nucanoe.com/product/7110-u-joint-tiller-extension/.

* cited by examiner

APPARATUS FOR MOUNTING AN OUTBOARD MOTOR TO A TRANSOM OF A BOAT

CROSS-REFERENCE TO RELATED APPLICATIONS

The present application claims benefit of provisional Application No. 63/538,774, filed Sep. 15, 2023; all which is incorporated herein in its entirety and referenced thereto.

BACKGROUND OF THE INVENTION

Field of the Invention

The present invention relates to a mechanism for mounting an outboard motor to a boat, and in particular, relates to an apparatus for mounting an outboard motor to a transom of a boat in order to vertically adjust the height of the outboard motor.

Description of the Prior Art

It is known that outboard motors are commonly used on boats as propulsion systems for the boats. A typical outboard motor includes a self-contained unit having an engine, gearbox, and propeller affixed at the outside of the transom. In some instances, the boats are provided with a support bracket such as a jack plate, for example. The support bracket is generally mounted on the boat's transom and the outboard motor is connected to the outboard motor. The support bracket allows setback and vertical movement of the outboard motor along the transom.

Several support brackets or devices have been disclosed in the past for mounting the outboard motors onto the boats. One such device is disclosed in a U.S. Pat. No. 9,598,159, entitled "Spring-assisted jack plate for outboard motor" ("the '159 Patent"). The '159 Patent discloses a jack plate that includes a mounting assembly having first and second spacing brackets connected by a transom plate adapted for mounting to the transom of a boat, each of the spacing brackets having inwardly facing channels at rearward sides of the spacing brackets. The jack plate further includes a motor lift including a lift plate extending between a first bearing and a second bearing, the channels adapted to conformingly receive the first and second bearings. An actuator is provided to raise and lower the lift plate relative to the transom plate. At least one spring is operably coupled between the mounting assembly and the motor lift, the spring unloading the lift plate to reduce load on the actuator. The spring is optionally a compression gas spring.

Another device is disclosed in a United States Publication No. 20050279912, entitled "Outboard motor lift" ("the '912 Publication"). The '912 Publication discloses an outboard motor lift characterized by a lift assembly fitted to the transom of a boat and including parallel upper and lower links joining a bracket system attached to the boat transom with a motor mount bracket carrying an outboard motor, such that the outboard motor can move freely vertically up and down with respect to the transom responsive to contacting an underwater obstacle. Under circumstances where the outboard motor is heavy a spring system may be added to the lift assembly to offset the motor weight and facilitate vertical movement of the outboard motor by operation of the parallel links with minimal force when the outboard motor contacts the underwater obstacle. A handle coupled to another set of parallel links and a lift mechanism facilitate vertical adjustment and support of the lift assembly links and the outboard motor at selected operating positions. Since the outboard motor is positioned in spaced-apart relationship with respect to the transom, a throttle extension may be provided for comfortably operating the motor throttle when the lift assembly is in functional configuration.

Another device is disclosed in a United States Granted U.S. Pat. No. 8,597,066, entitled "Lightweight outboard electric motor system" ("the '066 Patent"). The '066 Patent discloses an outboard electric motor kit that includes an electric motor assembly with a unitized propeller hub, a transom mount, a rechargeable electric battery, and an optional recharger. The assembly includes an electric motor unit located in an upper housing. A lower tube stem is attached and that extends downward from the upper housing to a lower housing. Formed on the lower housing is a receiving cavity with a rearward facing propeller hub opening. A drive shaft coupled to the motor unit extends downward inside the lower tube stem and mounted to a gear support block located in the receiving cavity. Mounted on the end of the drive shaft is a main gear. Mounted on the gear support block is a fixed axle that extends coaxially aligned through the propeller hub opening. Extended through the opening and coaxially mounted over the fixed axle is a removable propeller hub assembly.

Yet another device is disclosed in a U.S. Pat. No. 10,583,906, entitled "Automatically releasing pivot clamp module for an outboard motor" ("the '906 Patent"). The '906 Patent discloses an assembly that includes a pivoting body member connectable to an outboard motor assembly, wherein the pivoting body member is movable along a transition path having a locked condition endpoint and an unlocked condition endpoint. A pivoting latch seat mechanically cooperates with a fixed latch pin in the assembly to maintain the pivoting latch seat and the outboard motor assembly in a locked condition when the outboard motor assembly is in a lowered position. The pivoting latch seat is mounted and arranged to disengage from the fixed latch pin to an unlocked condition when the pivoting body member is moved along the transition path to the unlocked condition endpoint, thereafter permitting movement of the outboard motor assembly to a raised position.

Although the above discussed disclosures are useful, they are difficult to use in shallow water. This is because; existing devices may damage the propeller and lower unit as they do not allow sufficient vertical adjustment of the outboard motor. Further, existing devices leave the motor powerless which is unsafe for passengers.

Therefore, there is a need in the art to provide an improved apparatus for mounting an outboard motor to a transom of a boat in order to vertically adjust the height of the outboard motor.

SUMMARY OF THE INVENTION

It is an object of the present invention to provide an apparatus for mounting an outboard motor to a boat that avoids the drawback of known devices.

It is another object of the present invention to provide an apparatus for mounting an outboard motor to a transom of a boat in order to vertically adjust the height of the outboard motor.

In order to achieve one or more objects, the present invention provides an apparatus for mounting an outboard motor to a transom of a boat. The apparatus includes a pair of first mounting plates and a pair of second mounting plates positioned opposite to each other. The first mounting plates and the second mounting plates connect via connecting plates. The first mounting plates connect to a transom of the boat and the second mounting plates connect to a motor plate, which in turn connects to the outboard motor. The apparatus includes a first support plate connected to the transom. The first support plate positions in between the first mounting plates. The first mounting plates include holes at the bottom. The holes receive a first rod, which defines the vertical bottom position of the outboard motor in relation to the transom.

The first support plate includes a spring member connected to a second rod. The second rod connects at the bottom of the second mounting plates. The apparatus includes an actuator. The actuator comes in a L-shaped configuration. The actuator draws through the first mounting plates and the first support plate. A user engages the actuator which in turn engages the spring member. The spring member engages the second rod lifting the outboard motor vertically raising the height of the outboard motor along the transom. Here, the travel of the apparatus starts at one of the holes with the help of the first rod stopping the connecting plates. From that position, the user has the complete control of upward movement of the outboard motor and if desired downward force of travel by controlling the actuator.

In one advantageous feature of the present invention, the apparatus presents an offset outboard motor mount/apparatus linked to the transom of the boat with up to 6" of vertical travel/movement depending on the boat.

In another advantageous feature of the present invention, the travel of the apparatus starts from one of the holes at the first mounting plates where the first rod positions. From that position, the user will be able to operate the outboard motor in the upward direction.

In another advantageous feature of the present invention, the apparatus allows the user to control the depth of the propeller of the outboard motor with one hand and use the other hand to control the tiller and speed of the boat. The user can adjust the vertical movement (complete up and down control) of the outboard motor by simply controlling the actuator with one hand. Any cavitation that might occur during raising of the outboard motor is remedied by reverse motion of the actuator with one hand.

In yet another advantageous feature of the present invention, the user operates the actuator with his/her right hand, and operates the tiller and controls the speed of the boat with left hand. Further, the user can use the right hand to control the depth of the propeller of the outboard motor. When there is an obstacle, the user can use the right hand to control the actuator in order to raise the outboard motor over and out of the way of the obstacle without making contact with the obstacles.

The features and advantages of the invention here will become more apparent in light of the following detailed description of selected embodiments, as illustrated in the accompanying FIGURES. As will be realized, the invention disclosed is capable of modifications in various respects, all without departing from the scope of the invention. Accordingly, the drawings and the description are to be regarded as illustrative in nature.

DETAILED DESCRIPTION OF THE PREFERRED EMBODIMENT

Figure 1:
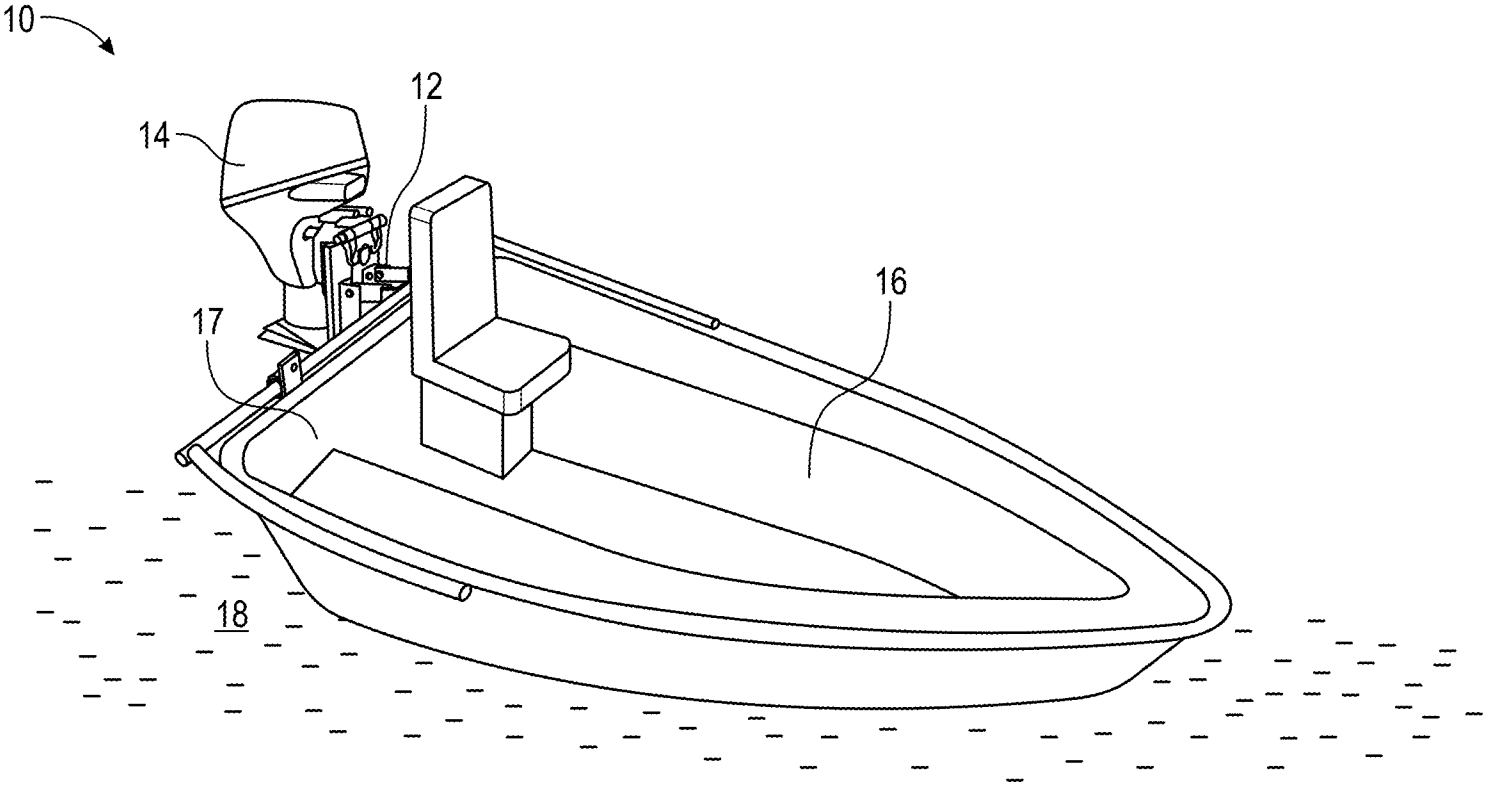
FIG. 1 is an environment in which an apparatus for mounting an outboard motor to a transom of a boat implements, in accordance with one embodiment of the present invention.

The following detailed description set forth below in connection with the appended drawings is intended as a description of exemplary embodiments in which the presently disclosed invention may be practiced. The term "exemplary" used throughout this description means "serving as an example, instance, or illustration," and should not necessarily be construed as preferred or advantageous over other embodiments. The detailed description includes specific details for providing a thorough understanding of the presently disclosed apparatus. However, it will be apparent to those skilled in the art that the presently disclosed invention may be practiced without these specific details. In some instances, well-known structures and devices are shown in functional or conceptual diagram form in order to avoid obscuring the concepts of the presently disclosed apparatus.

In the present specification, an embodiment showing a singular component should not be considered limiting. Rather, the invention preferably encompasses other embodiments including a plurality of the same component, and vice-versa, unless explicitly stated otherwise herein. Moreover, the applicant does not intend for any term in the specification to be ascribed an uncommon or special meaning unless explicitly set forth as such. Further, the present invention encompasses present and future known equivalents to the known components referred to herein by way of illustration.

Although the present invention provides a description of an apparatus, it is to be further understood that numerous changes may arise in the details of the embodiments of the apparatus. It is contemplated that all such changes and additional embodiments are within the spirit and true scope of this disclosure.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure.

The present invention discloses an apparatus for mounting an outboard motor to a transom of a boat in order to vertically adjust the height of the outboard motor. The apparatus includes a pair of first mounting plates and a pair of second mounting plates positioned opposite to each other. The first mounting plates and the second mounting plates connect via connecting plates. The first mounting plates connect to the transom of the boat and the second mounting plates connect to the outboard motor. The apparatus includes a first support plate connected to the transom. The first mounting plates include holes at the bottom. The holes receive a first rod, which defines the vertical position of the outboard motor in relation to the transom. Here, the travel of the apparatus starts at one of the holes with the help of the first rod stopping the connecting plates. From that position, the user has the complete control of upward movement of the outboard motor and if desired downward force of travel by controlling the actuator. The first support plate includes a spring member connected to a second rod at the second mounting plates. The apparatus includes an actuator. The actuator engages the spring member to move the outboard motor vertically.

Various features and embodiments of an apparatus for mounting outboard motors onto boats are explained in conjunction with the description of FIGS. 1-7.

FIG. 1 shows an environment 10 in which an apparatus 12 for mounting an outboard motor to a transom of a boat implements, in accordance with one embodiment of the present invention. Apparatus 12 helps to support an outboard motor 14 of a boat 16 and raise or lower outboard motor 14 relative to a transom 17 of boat 16. As known, transom 17 indicates the vertical cross section portion of boat 16 that offers a location to mount outboard motor 14. FIG. 1 shows boat 16 over a waterbody 18.

Figure 2A:
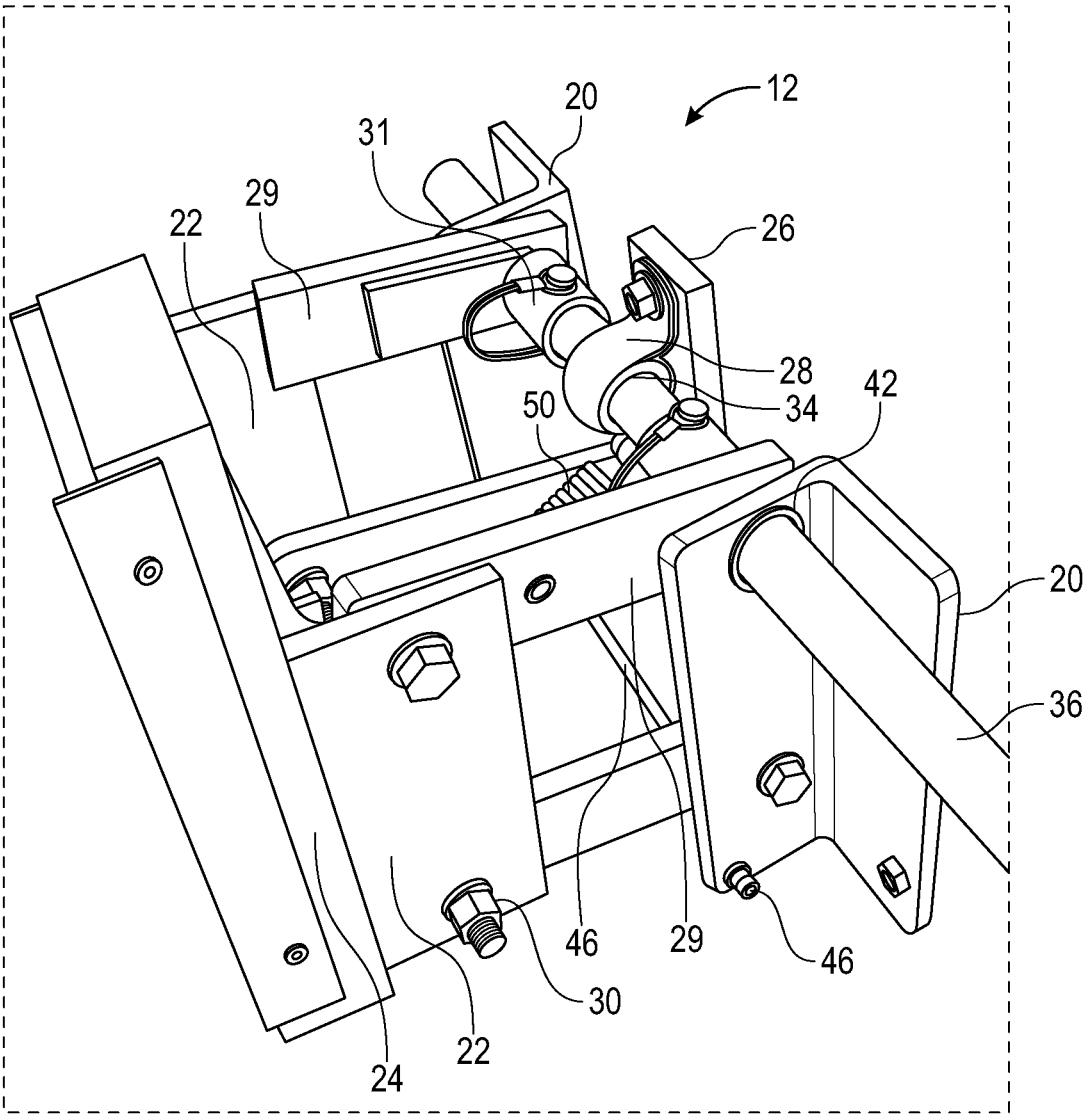
FIG. 2A and FIG. 2B show a side perspective view and a top perspective view, respectively of the apparatus, in accordance with one embodiment of the present invention.
Figure 2B:
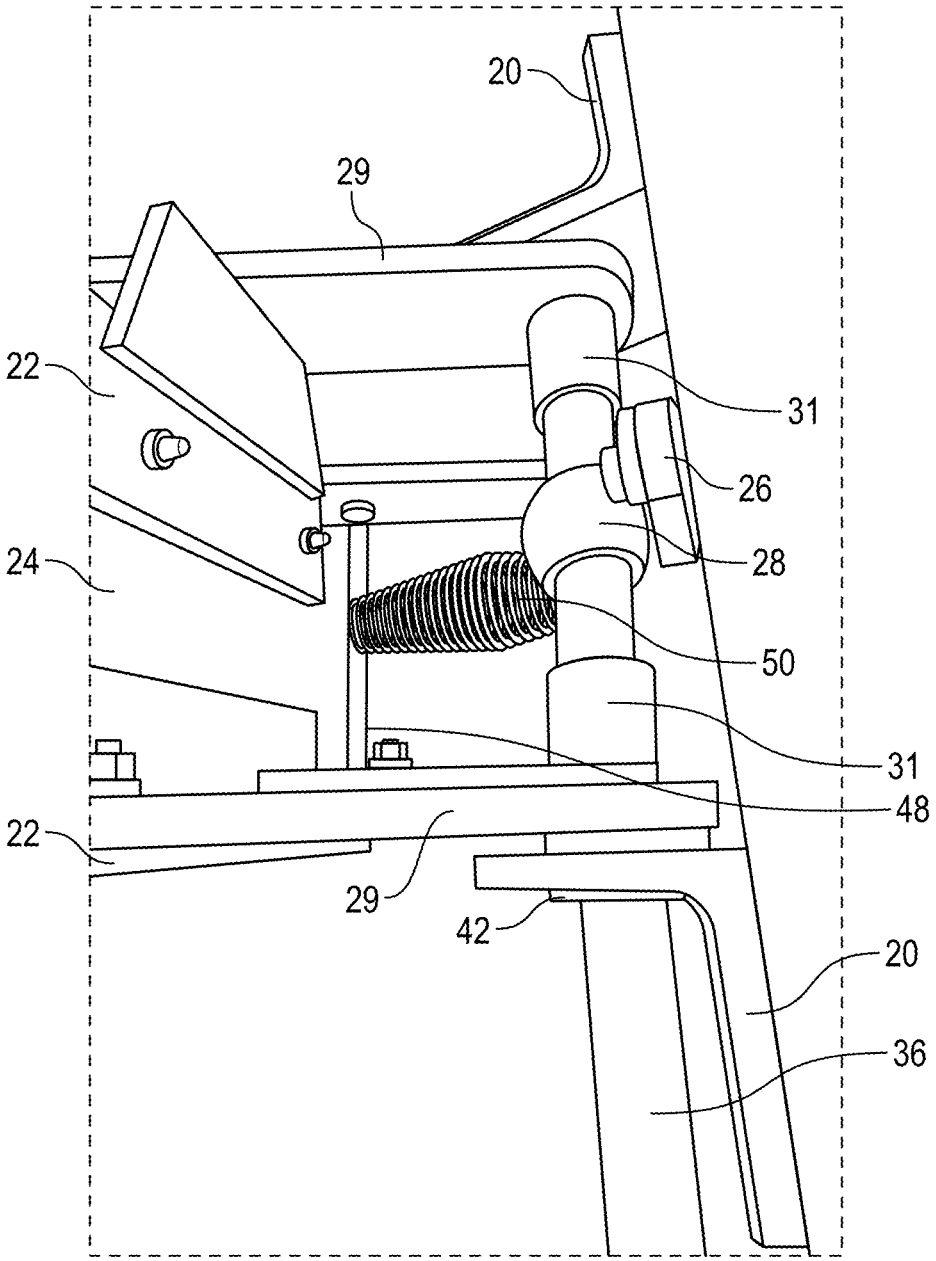
Figure 4:
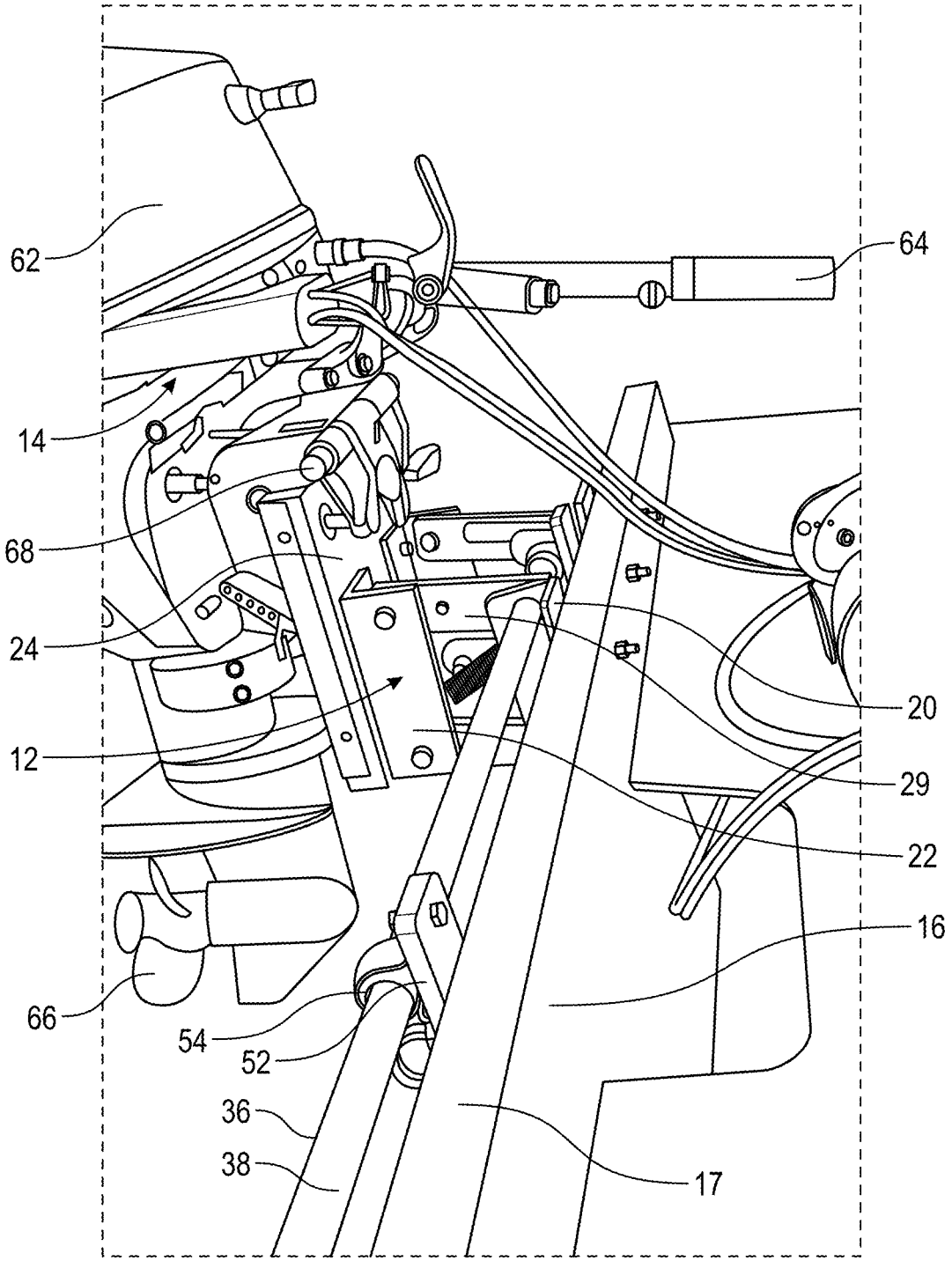
FIG. 4 and FIG. 5 illustrate side perspective view of the apparatus connecting the outboard motor to the transom of the boat, in accordance with one embodiment of the present invention.

FIG. 2A and FIG. 2B show a side perspective view and a top perspective view, respectively of apparatus 12, in accordance with one embodiment of the present invention. Apparatus 12 includes a pair of first mounting plates 20 and a pair of second mounting plates 22 positioned opposite to each other. Each of first mounting plate 20 and second mounting plate 22 indicates a jack plate configured for connecting outboard motor 14 to boat 16. In the present invention, first mounting plates 20 connect to transom 17 of boat 16. In one example, first mounting plates 20 connect to transom 17 using fasteners, welding, or any other known mechanism. Further, second mounting plates 22 connect to outboard motor 14 via a motor plate 24. Motor plate 24 indicates a flat plate made up of metal, wood or any other suitable material. Motor plate 24 receives outboard motor 14 at the top with the help of mounting bracket 68 of outboard motor 14, as shown in FIG. 4, for example. Further, motor plate 24 receives second mounting plates 22 at the opposite end of outboard motor 14 facing transom 17 of boat 16.

Apparatus 12 includes a first support plate 26. First support plate 26 indicates a flat rectangular plate made up of metal, wood or any other suitable material. First support plate 26 connects to transom 17 in parallel and in between first mounting plates 20, as shown in at least FIG. 5. First support plate 26 includes a ring 28. Ring 28 indicates a semi-circular structure or C-shaped ring-like structure extending from the surface of first support plate 26 forming a hole 34 therebetween with first support plate 26. Apparatus 12 further includes connecting plates 29. Connecting plates 29 connect first mounting plates 20 and second mounting plates 22, as can be seen from FIG. 2A and FIG. 2B. Here, connecting plates 29 extend from first mounting plates 20 in perpendicular to transom 17 and connect to second mounting plates 22. In one example, connecting plates 29 connect to first mounting plates 20 and second mounting plates 22 with the help of fasteners 30 or any other mechanism.

Apparatus 12 further includes an actuator or a lever or a handle 36. Actuator 36 is made of a metal or any other suitable material. Actuator 36 comes in a L-shaped configuration having a first section 38 and a second section 40. It is understood that first section 38 and second section 40 are in perpendicular i.e., second section 40 extends from one end of first section 38 in perpendicular. Here, first section 38 draws through first mounting plates 20 and connecting plates 29 at the top, and through hole 34 of ring 28, as shown in at least FIG. 2A. In one example, apparatus 12 includes support members 31. Support members 31 position adjacent to connecting plates 29 and help to lock the position of first mounting plates 20 and connecting plates 29 over first section 38 with the help of washers 42 on the farther ends. FIG. 2A and FIG. 2B show washers 42 at opposite sides of first mounting plates 20 used for locking the position of first section 38 with first mounting plates 20 and connecting plates 29.

Figure 3:
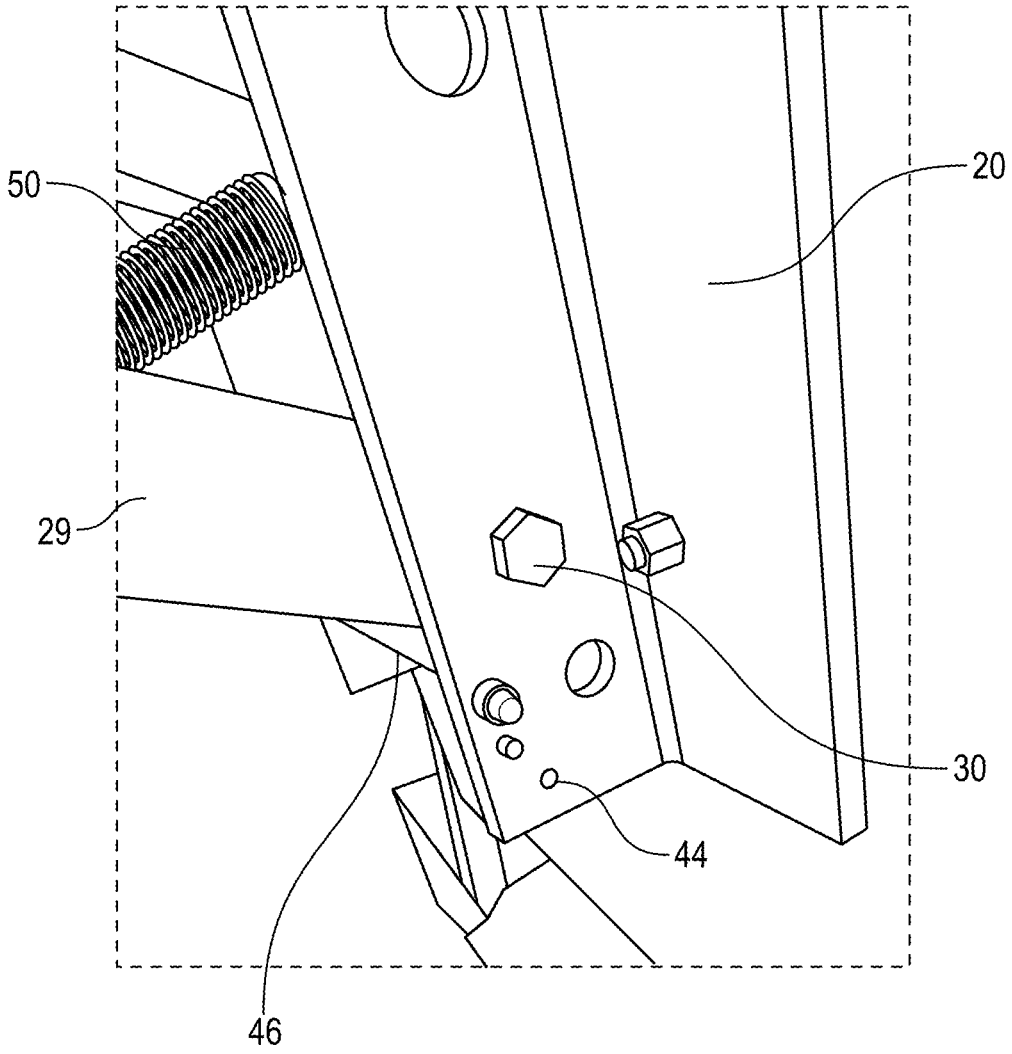
FIG. 3 is the feature of a first mounting plate having holes for receiving a first rod, in accordance with one embodiment of the present invention.

In addition, each of first mounting plates 20 includes holes 44 at the bottom. FIG. 3 shows the feature of holes 44 at first mounting plates 20, in accordance with one embodiment of the present invention. In one embodiment, holes 44 are positioned in parallel. In another embodiment, holes 44 are positioned in an arc fashion depending on the need. In the present invention, a first rod 46 is drawn through the holes 44 provided at opposite first mounting plates 20. First rod 46 defines the angle at which connecting plates 29 can swing with respect to first mounting plates 20 to determine the height at which outboard motor 14 raises vertically. In other words, Here, the travel of connecting plates 29 starts at one of the holes with the help of first rod 46, which acts as a bottom starting point for raising outboard motor 14. Further, apparatus 12 includes a second rod 48 connecting opposite second mounting plates 22, as shown in FIG. 2B.

In accordance with one embodiment of the present invention, apparatus 12 includes a spring member 50. Spring member 50 extends from first support plate 26 underneath ring 28. Spring member 50 has a suitable strength to withstand the weight and forces being acted upon apparatus 12 and outboard motor 14. As can be seen from FIG. 2A and FIG. 2B, one end of spring member 50 connects to first support plate 26 and other end connects to second rod 48. In one alternate embodiment, two spring members (not shown) may connect adjacent to first mounting plates 20 and connect to first section 38 and second rod 48. In yet alternate embodiment, three spring members (not shown) may be provided whereby one spring member connects in the middle as shown in FIG. 2A and two spring members may be provided adjacent to first mounting plates 20 and connect to first section 38 and second rod 48. A single spring member 50 with suitable strength is preferred for ease of operation and number of components needed to implement the present invention.

Furthermore, apparatus 12 includes a second plate 52 with a second ring 54, as shown in FIG. 4, for example. Second plate 52 connects at a distance from first mounting plates 20 and supports first section 38 of actuator 36. Additional plates might be provided along transom 17 of boat 16 to support first section 38 of actuator 36. Further, second section 38 is positioned adjacent to boat 16 allowing a user/operator (not shown) to engage actuator 36, as shown in FIG. 5.

Figure 5:
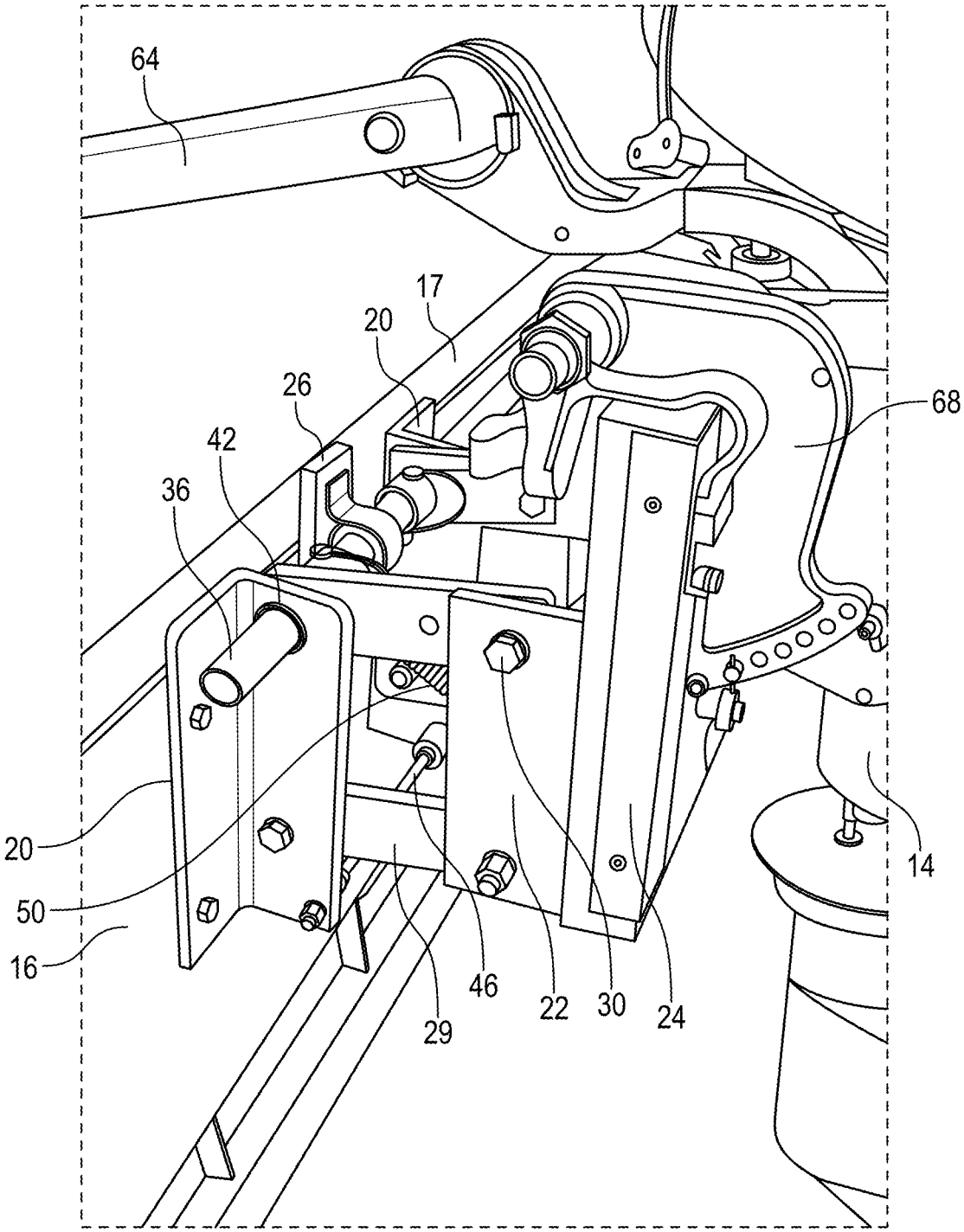

Referring to FIG. 4 and FIG. 5, side perspective views of apparatus 12 connecting outboard motor 14 to transom 17 of boat 16 are shown, in accordance with one embodiment of the present invention. As known, boat 16 includes a seat 60 for the user to be seated up on. Further, outboard motor 14 includes a power head 62, a tiller 64, a propeller 66, and a mounting bracket 68. As can be seen, mounting bracket 68 connects to motor plate 24 and secures to outboard motor 14 to transom 17 of boat 16 via apparatus 12.

Figure 6:
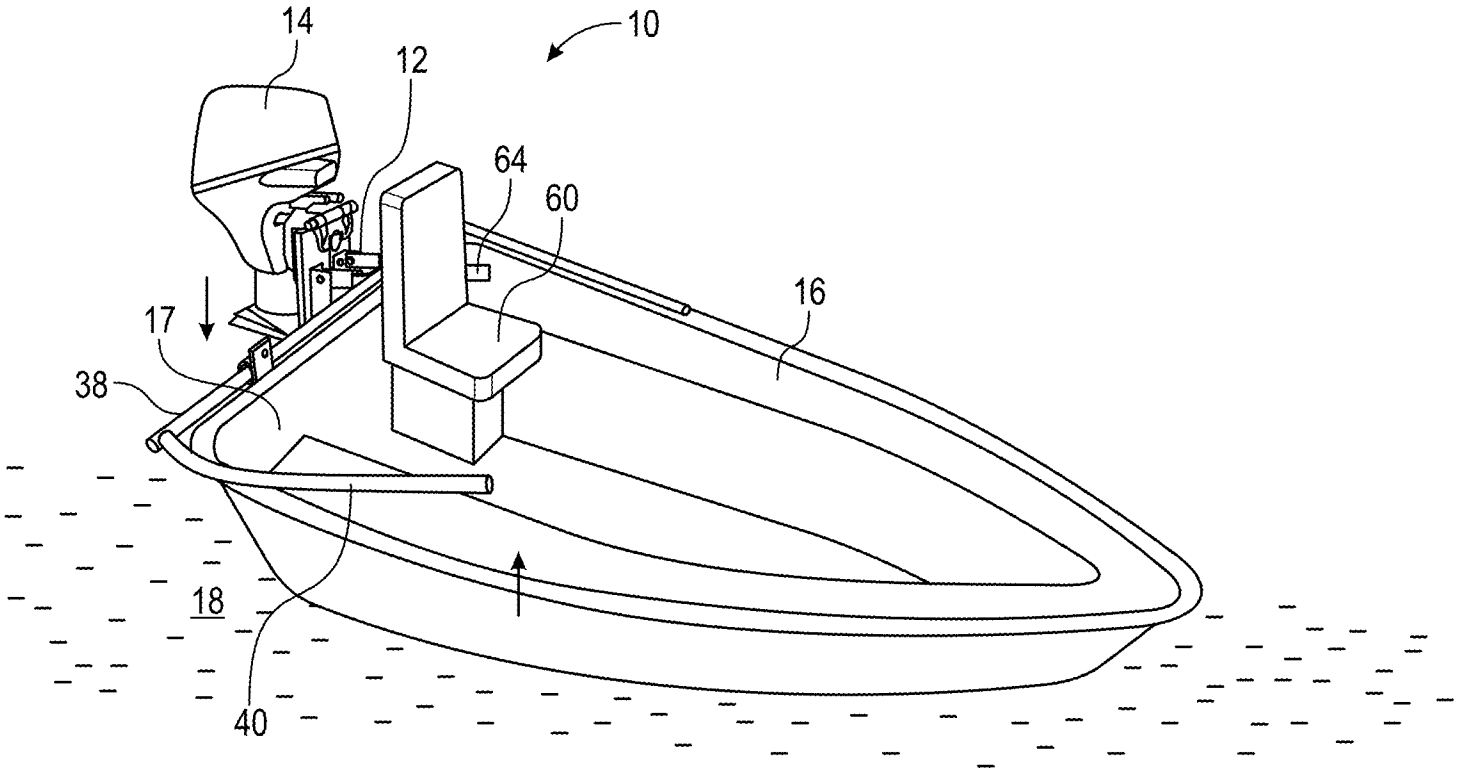
FIG. 6 illustrates operation of the apparatus for adjusting the vertical movement of the outboard motor along the transom, in accordance with one embodiment of the present invention.

Referring to FIG. 1 and FIG. 6, the operation of apparatus 12 is explained, in accordance with one embodiment of the present invention. FIG. 1 shows the feature of actuator 36 in a first position. In the first position, second section 40 rests flat over or adjacent to boat 16 and spring member 50 is engaged such that outboard motor 14 is made to raise at a height. In order to lower outboard motor 14, second section 38 is lifted or raised such that spring member 50 is disengaged thereby lowering outboard motor 14 along transom 17, as shown in FIG. 6. Here, connecting plates 29 lower and rest over first rod 46 and define the bottom height of outboard motor 14. When needed, the user pushes second section 38 down, raising connecting plates 29 which in turn raises outboard motor 14 up in a vertical movement along transom 17, as shown in FIG. 1.

As specified above, first rod 46 is positioned in any of the desired holes 44 to define the height or vertical movement of outboard motor 14 along transom 17. For instance, if the height or vertical movement needs to be more, then first rod 46 is positioned in bottom holes 44 such that connecting plates 29 can lower much further to come in contact with first rod 46 and increase the vertical movement of outboard motor 14 along transom 17. Alternatively, if the height or vertical movement needs to be less, then first rod 46 is positioned in top holes 44 such that connecting plates 29 can lower much less to come in contact with first rod 46 and define the vertical movement of outboard motor 14 along transom 17. In other words, the travel of apparatus 10 starts at one of the holes 44 with the help of first rod 46 stopping connecting plates 29. From that position, the user has the complete control of upward and if desired downward force of travel by controlling actuator 36.

Considering that the user operates actuator 36 with his/her right hand, then the left hand will have plenty to do with tiller 64 and speed. The user can use the right hand to control the depth of propeller 66 of outboard motor 14. When there is an obstacle, the user can use the right hand to control actuator 36 in order to raise outboard motor 14 over and out of the way of the obstacle without making contact with the obstacles.

Figure 7:
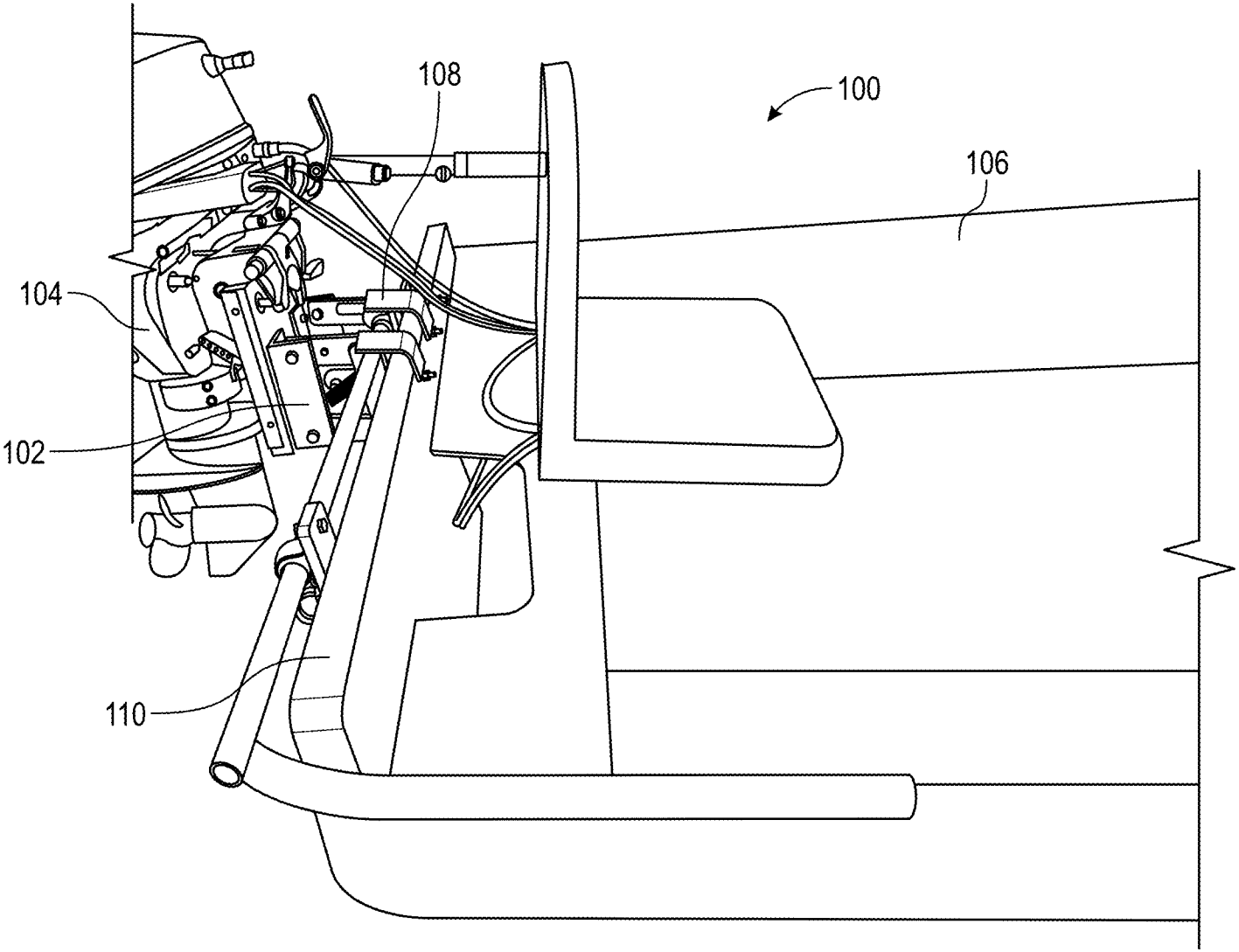
FIG. 7 is an environment in which an apparatus for mounting an outboard motor to a transom of a boat implements, in accordance with another embodiment of the present invention.

FIG. 7 shows an environment 100 in which an apparatus 102 implements to connect an outboard motor 104 to a boat 106, in accordance with the other embodiment of the present embodiment. In the present embodiment, apparatus 102 includes and operates similar to apparatus 12 explained above. In one example, apparatus 102 includes U-shaped brackets 108 that connect to a transom 110 of boat 106. U-shaped brackets 108 indicate hook-like structures configured for connecting apparatus 102 to transom 110. Further, outboard motor 104 connects to apparatus 102 similar to apparatus 12, as explained above. A person skilled in the art understands that L-shaped plates or U-shaped brackets can be replaced with any other connecting means without deviating from the scope of the present invention.

The presently disclosed apparatus provides several advantages over the prior art. The apparatus presents an offset outboard motor mount linked to the transom of the boat with up to 6" of vertical travel/movement depending on the boat. The apparatus allows the user to control the depth of the propeller of the outboard motor with one hand and use the other hand to control the tiller and speed. The user can adjust the vertical movement (complete up and down control) of the outboard motor by simply controlling the actuator with one hand. The apparatus can be used to raise or lower the outboard motor when operating the boat in shallow water or removing the boat from the water with a submersible boat trailer such that the propeller and rudder are not damaged by the bottom of the body of water. In some instances, the apparatus can be used to raise or lower the outboard motor when the boat is operated at high speed in order to reduce the amount of drag created by the presence of the outboard motor in the water.

A person skilled in the art appreciates that the railroad safety system can come in a variety of shapes and sizes depending on the need and comfort of the user. Further, many changes in the design and placement of components may take place without deviating from the scope of the presently disclosed apparatus.

In the above description, numerous specific details are set forth such as examples of some embodiments, specific components, devices, methods, in order to provide a thorough understanding of embodiments of the present invention. It will be apparent to a person of ordinary skill in the art that these specific details need not be employed, and should not be construed to limit the scope of the invention.

In the development of any actual implementation, numerous implementation-specific decisions must be made to achieve the developer's specific goals, such as compliance with system-related and business-related constraints. Such a development effort might be complex and time-consuming, but may nevertheless be a routine undertaking of design, fabrication, and manufacture for those of ordinary skill. Hence as various changes could be made in the above constructions without departing from the scope of the invention, it is intended that all matter contained in the above description or shown in the accompanying drawings shall be interpreted as illustrative and not in a limiting sense.

The foregoing description of embodiments is provided to enable any person skilled in the art to make and use the invention. Various modifications to these embodiments will be readily apparent to those skilled in the art, and the novel principles and invention disclosed herein may be applied to other embodiments without the use of the innovative faculty. It is contemplated that additional embodiments are within the spirit and true scope of the disclosed invention.

What is claimed is:

1. An apparatus for mounting an outboard motor to a transom of a boat, said apparatus comprising:

first mounting plates configured to connect to said transom;

second mounting plates positioned opposite to said first mounting plates, wherein said second mounting plates receive an outboard motor a top thereof;

a support plate positioned between said first mounting plates, wherein said support plate connects to said transom, wherein said support plate comprises a ring;

connecting plates connecting said first mounting plates and said second mounting plates;

an actuator drawn through said first mounting plates said connecting plates and said ring; and a spring member operatively connected to said actuator, and positioned between said first mounting plates and said second mounting plates, wherein said actuator is operated to raise or lower said second mounting plates via said spring member and said connecting plates, with respect to said first mounting plates, to adjust a height of said outboard motor positioned over said second mounting plates.

2. The apparatus of claim 1, wherein said actuator comprises a first section and a second section extending perpendicularly from said first section, and wherein said first section draws through said first mounting plates and said connecting plates.

3. The apparatus of claim 1, wherein said spring member connects to said ring.

4. The apparatus of claim 1, wherein said first mounting plates comprise a plurality of holes positioned at different heights, and wherein said plurality of holes is configured to receive a first rod.

5. The apparatus of claim 4, wherein said first rod inserts in said plurality of holes such that said connecting plates position over said first rod defining a bottom position of said second mounting plates with respect to said first mounting plates.

6. The apparatus of claim 1, wherein said first mounting plates comprise L-shaped plates or U-shaped brackets.

7. The apparatus of claim 6, wherein said second mounting plates comprise L-shaped plates.

8. The apparatus of claim 1, further comprises support members positioned adjacent to said first mounting plates to lock said connecting plates to said first mounting plates.

9. An apparatus for mounting an outboard motor to a transom of a boat, said apparatus comprising:

first mounting plates configured to connect to said transom;

second mounting plates positioned opposite to said first mounting plates, wherein said second mounting plates receive an outboard motor at a top thereof;

a support plate positioned between said first mounting plates, wherein said first support plate connects to said transom, and wherein said support plate comprises a ring;

connecting plates connecting said first mounting plates and said second mounting plates;

an actuator comprising a first section and a second section extending from said first section, wherein said first section draws through said first mounting plates, said connecting plates and said ring; and a spring member connecting said ring and said second mounting plates, wherein said second section of said actuator is operated to raise or lower said second mounting plates via said spring member and said connecting plates, with respect to said first mounting plates, to adjust a height of said outboard motor positioned over said second mounting plates.

10. The apparatus of claim 9, wherein said first mounting plates comprise a plurality of holes positioned at different heights, and wherein said plurality of holes is configured to receive a first rod.

11. The apparatus of claim 10, wherein said first rod inserts in said plurality of holes such that said connecting plates position over said first rod defining a bottom position of said second mounting plates with respect to said first mounting plates.

12. The apparatus of claim 9, wherein said first mounting plates comprise L-shaped plates or U-shaped brackets.

13. The apparatus of claim 12, wherein said second mounting plates comprise L-shaped plates.

14. The apparatus of claim 9, further comprises support members positioned adjacent to said first mounting plates to lock said connecting plates to said first mounting plates.

15. A method of providing an apparatus for mounting an outboard motor to a transom of a boat, said method comprising the steps of:

providing first mounting plates configured to connect to said transom;

providing second mounting plates positioned opposite to said first mounting plates, said second mounting plates receiving an outboard motor at a top thereof;

providing a support plate having a ring positioned between said first mounting plates;

connecting said support plate to said transom;

providing connecting plates connecting said first mounting plates and said second mounting plates;

providing an actuator and drawings said actuator through said first mounting plates said connecting plates, and said ring;

providing a spring member operatively connecting to said actuator, and positioned between said first mounting plates and said second mounting plates; and operating said actuator to raise or lower said second mounting plates via said spring member and said connecting plates, with respect to said first mounting plates, to adjust a height of said outboard motor positioned over said second mounting plates.

16. The method of claim 15, further comprising providing plurality of holes at a bottom of said first mounting plates, said plurality of holes configured to receive a first rod.

17. The method of claim 16, further comprising inserting said first rod for positioning said connecting plates over said first rod defining a bottom position of said second mounting plates with respect to said first mounting plates.

18. The method of claim 15, further comprising providing said first mounting plates having L-shaped plates or U-shaped brackets, and said second mounting plates having L-shaped plates.

* * * * *